US005366001A

United States Patent [19]

Freedman et al.

[11] Patent Number: 5,366,001

[45] Date of Patent: Nov. 22, 1994

[54] METHOD OF MANUFACTURING ROLLED MATERIAL FROM OXYGEN-FREE COPPER

[75] Inventors: Lev P. Freedman, Uliza Funsie; Yermek B. Khafizov, Uliza Gorkowo, both of Kazakhstan; Elmar Buch, Essen, Germany; Kurt Siebel, Kreuztal, Germany; Herbert Berendes, Mülheim, Germany

[73] Assignee: Mannesmann Aktiengesellschaft, Dusseldorf, Germany

[21] Appl. No.: 969,884

[22] Filed: Oct. 30, 1992

[30] Foreign Application Priority Data

Oct. 30, 1991 [DE] Germany ..... 4136085

[51] Int. Cl.[5] ..... B22D 11/12

[52] U.S. Cl. ..... 164/475; 164/415; 164/417; 164/476

[58] Field of Search ..... 164/475, 476, 415, 417

[56] References Cited

U.S. PATENT DOCUMENTS

| | | | |
|---|---|---|---|
| 2,264,289 | 12/1941 | Betterton et al. | 164/475 |
| 3,089,209 | 5/1963 | Phillips et al. | 164/475 |
| 3,257,835 | 6/1966 | Cofer et al. | 164/475 |
| 4,290,823 | 9/1981 | Dompas | 164/476 X |
| 4,754,803 | 7/1988 | Escobar, Jr. et al. | 164/476 X |

FOREIGN PATENT DOCUMENTS

| | | | |
|---|---|---|---|
| 3214211 | 12/1982 | Germany | 164/475 |
| 63-171255 | 7/1988 | Japan | 164/476 |

*Primary Examiner*—J. Reed Batten, Jr.
*Attorney, Agent, or Firm*—Cohen, Pontani, Lieberman, Pavane

[57] ABSTRACT

Oxygen-free copper, particularly wire, is manufactured in a casting and rolling plant composed of melting plant, continuous casting mold and a subsequently arranged continuous rolling mill. The method includes bending a billet leaving the casting plant along a straight line into the horizontal, after the billet has been reduced in at least one shaping pass. The arrangement for carrying out the method includes at least one shaping stand arranged following the continuous casting mold, wherein the rolling axis of the shaping stand coincides with the longitudinal center axis of the continuous casting mold. The region between melting furnace and continuous casting mold and the region between continuous casting mold and the shaping stand are arranged under gas shrouding.

9 Claims, 1 Drawing Sheet

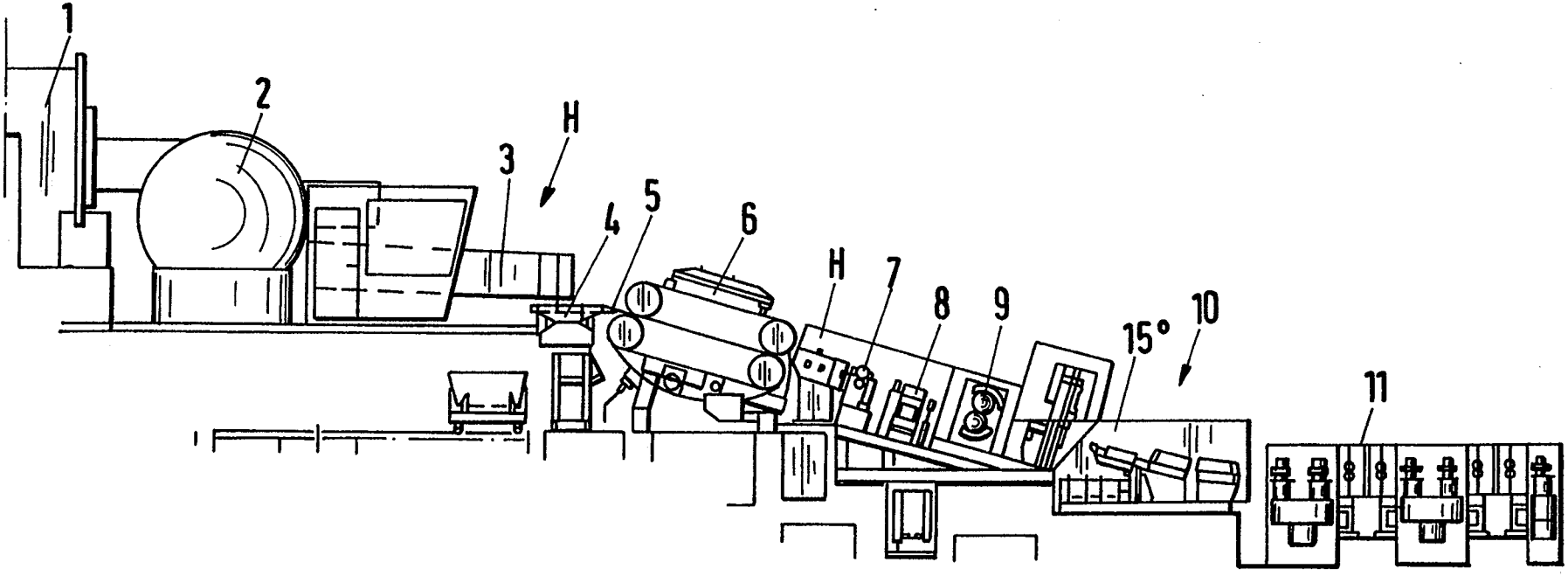
1
2
3
H
4
5
6
H
7
8
9
15°
10
11

METHOD OF MANUFACTURING ROLLED MATERIAL FROM OXYGEN-FREE COPPER

BACKGROUND OF THE INVENTION

1. Field of the Invention

The present invention relates to a method of manufacturing rolled material of oxygen-free copper, particularly wire, in a casting and rolling plant which includes a melting plant, a casting plant with inclined following mold, as well as a subsequently arranged continuous rolling mill. The invention further relates to an arrangement for carrying out the method.

2. Description of the Related Art

For manufacturing copper wire, plants have been built for approximately 25 years which manufacture the copper wire in a continuous sequence from liquid melt through a casting machine with following molds and a continuous rolling mill with subsequently arranged wire scouring path. This copper wire is wound at the end of the plant into coils of up to 10 tons.

During melting, casting and subsequent rolling, the copper billets or the copper wire takes up oxygen which is harmless for some purposes, but has a damaging effect in many types of applications, particularly when used in the electronics industry. For this particular purpose, it is absolutely necessary to reduce the oxygen content in the copper wire or to completely eliminate the oxygen content.

SUMMARY OF THE INVENTION

Therefore, it is the primary object of the present invention to provide a method, and an arrangement for carrying out the method, which makes it possible to produce oxygen-free copper wire in-line in a casting and rolling plant of the above-described type.

The present invention is based on the finding that the phenomena of hydrogen embrittlement known to those skilled in the art can be overcome in oxygen-free copper.

In copper which contains oxygen, the oxygen reacts with the hydrogen contained in the copper to form steam. This reaction produces very high pressures which lead to cracks along the grain boundaries and to ruptures and finally to breaking up of a cast warm copper billet. In connection with the accompanying elements contained in the copper, such as impurities, the danger of cracks and breakage is further increased, particularly when bending the cast hot billet.

Even when melting and casting are carried out under gas shrouding, oxygen-free copper still contains defined amounts of hydrogen. However, the small hydrogen bubbles combine to form large hydrogen bubbles at the grain boundaries and which leads to hot shortness and which must be prevented, particularly when simultaneously bending the hot copper billet. The possibility of the formation of undesired large hydrogen blisters increases with increasing time available from the solidification of the liquid copper.

In accordance with the present invention, the object described above is met by bending the billet which leaves the casting plant in a straight line into the horizontal, after reducing the billet in at least one shaping pass.

Accordingly, in accordance with the invention, the copper billet is shaped or deformed immediately following the mold in order to reduce the grain sizes of the copper and to prevent larger hydrogen blisters from forming at the grain boundaries. The fine structure essentially prevents deep penetration of the hydrogen and, thus, forms an effective means against the susceptibility of the copper billet to cracking and breaking.

In accordance with another proposal of the present invention, the shaping pass of the billet and the melting and casting procedure take place in an inert gas atmosphere or under gas shrouding, so that the copper which has been melted with the exclusion of oxygen is prevented from taking up oxygen during the individual method steps.

The first shaping pass is advantageously carried out closely following the casting plant. Bending of the copper billet following the first reducing pass or several reducing passes in inert gas atmosphere is not harmful after the grain size has been reduced and no longer leads to the cracks which it was impossible in the past to prevent.

It has been found that particularly favorable results are obtained if the reduction in the first shaping pass is between 10 and 50%, preferably 35%.

In accordance with the present invention, a casting and rolling plant for carrying out the above-described method includes at least one shaping stand following the continuous casting mold, wherein the rolling axis of the shaping stand coincides with the longitudinal center axis of the continuous casting mold, and wherein the regions between melting furnace and continuous casting mold and between continuous casting mold and the first shaping stand or stands are arranged under shrouding.

Accordingly, the shaping unit arranged closely adjacent to the casting machine is arranged with the same inclination as the casting plant, wherein additional units for preparing the billet, such as, side trimming unit, driver, etc., may be arranged between the casting plant and the first shaping stand.

It is considered to be a particular advantage of the present invention that the arrangement can be used for manufacturing oxygen-free copper as well as for manufacturing oxygen-containing copper.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWING

In the Drawing:

The single figure of the drawing is a schematic illustration of the arrangement according to the present invention.

DESCRIPTION OF THE PREFERRED EMBODIMENT

As illustrated in the drawing, the casting and rolling plant according to the present invention includes a melting furnace 1, a holding furnace 2, a runner 3, a tundish 4, a pouring lip 5 of the tundish 4 extending into the region of a continuous casting mold 6. The plant further includes a driver 7, a side trimming device 8 and a shaping stand 9.

As is well known, in order to prevent the melt from taking up oxygen, the melt is covered with charcoal in the melting furnace 1 as well as in the holding furnace 2.

The present invention additionally provides shrouding of the melting furnace 1, the holding furnace 2, the runner 3 and the tundish 4 and operating these units in an inert gas atmosphere. The shrouding is designated with H in the drawing. All units are as tight as possible. Contrary to the conventional gas heating, all units are inductively heated. Nitrogen is preferably blown in in the travel direction of the material and flows toward the tundish where it exits together with the molten copper.

Because of its specific gravity as compared to air, the nitrogen flowing out of the tundish 4 protects the inlet region of the continuous casting mold 6 from taking up oxygen. In addition, laterally arranged protective plate constructions can have the effect that the nitrogen has a longer dwell time in this region and, thus, safely protects against oxygen.

Even though the strand which has solidified in the continuous casting mold 6 is no longer subject to the danger that the strand interior picks up oxygen, it is still necessary to prevent as much as possible the oxygen from combining with the strand surface which is hot from rolling. For this purpose, the shrouding is continued following the continuous casting mold 6 and includes the driver 7, the side trimming or bevelling device 8 and the shaping stand 9 and possibly the bending area 10. As provided by the teaching of the present invention, following the shaping stand 9, the billet is deflected in the bending area 10 from the casting direction into the horizontal direction.

The arrangement operates as follows: The copper melt in the melting furnace 1 is subjected to intermediate storage in the holding furnace 2 and is conducted through the runner 3 into the tundish 4. All units are sealed by a shrouding H, so that an inert gas atmosphere is provided in the interior of the shrouding H. From the tundish 4 through which nitrogen is conducted, the copper melt reaches the continuous casting mold in which copper billets are cast between strip-shaped mold sides and the copper billet leaves the continuous casting mold 6 in casting direction after solidification. The copper billet which has a temperature of 980° to 1000° C. is introduced by means of a driver 7 into the edge processing device 8, i.e. a bevelling machine, where the edges of the billet are bevelled. Subsequently, the copper billet prepared in this manner is introduced into the shaping stand.

Since the method according to the present invention requires a short distance between continuous casting melt 6 and the shaping stand 9, the shaping stand must have structural features which are usually not used in roughing stands in copper wire plants. Thus, the front end of the copper billet which still includes the dummy bar must be able to pass the shaping stand 9 without deformation. For this reason, the rolls of the shaping stand 9 are initially moved apart. When the desired strand speed has been reached, the rolls are automatically moved toward each other until the preselected reduction is reached. For this purpose, it is necessary that the speed of the rolls is determined and controlled in dependence on the respective deformation. This can be achieved by measuring the speed and the current consumption of the driver 7.

A pass reduction of approximately 35% takes place in the shaping stand 9. After leaving the shaping stand 9, the reduced copper billet is deflected in the bending area 10 of the plant on a roller conveyor into the horizontal direction and is further reduced in additional rolling stands of the continuous rolling train 11 in order to obtain wire. A deflection of 15° is shown in the drawing. The copper wire produced in this manner is placed into coils at the end, not shown, of the casting and rolling plant.

It should be understood that the preferred embodiments and examples described are for illustrative purposes only and are not to be construed as limiting the scope of the present invention which is properly delineated only in the appended claims.

What is claimed is:

1. A method of manufacturing rolled material of oxygen-free copper in a casting and rolling plant including a melting plant, a continuous casting mold and a subsequently arranged continuous rolling mill, wherein the continuous casting mold produces a billet which leaves the continuous casting mold in a straight line, the method comprising reducing the billet in at least one shaping pass and subsequently bending the billet into a horizontal direction.

2. The method according to claim 1, comprising carrying out the shaping pass of the billet in an inert gas atmosphere.

3. The method according to claim 1, comprising carrying out melting and casting in an inert gas atmosphere.

4. The method according to claim 3, comprising carrying out the at least one shaping pass immediately following the casting step.

5. The method according to claim 1, comprising reducing the billet in the at least one shaping pass between 10 and 50%.

6. The method according to claim 5, wherein the reduction is approximately 35%.

7. The method according to claim 1, wherein the billet leaves the continuous casting mold at an inclination and the billet is reduced in the at least one shading pass at the same inclination.

8. The method according to claim 1, additionally comprising the step of further reducing the horizontally bent billet in an additional horizontal rolling stand.

9. The method according to claim 1, wherein the at least one shaping pass is performed with rolls which rotate at a speed and comprising the additional step of determining and controlling the speed of the rolls in dependence on said bending.

* * * * *